US007360549B2

(12) United States Patent
Seo

(10) Patent No.: US 7,360,549 B2
(45) Date of Patent: Apr. 22, 2008

(54) COLLAPSIBLE CANOPY FRAME HAVING REDUCED TRUSS BAR LENGTH

(75) Inventor: Dong Woog Seo, Taegu (KR)

(73) Assignee: Caravan Canopy International, Inc., La Mirada, CA (US)

( * ) Notice: Subject to any disclaimer, the term of this patent is extended or adjusted under 35 U.S.C. 154(b) by 618 days.

(21) Appl. No.: 10/833,207

(22) Filed: Apr. 27, 2004

(65) Prior Publication Data

US 2005/0028856 A1 Feb. 10, 2005

(30) Foreign Application Priority Data

Aug. 6, 2003 (KR) ..... 20-2003-0025309 U

(51) Int. Cl.
*E04H 15/50* (2006.01)

(52) U.S. Cl. ..... 135/145

(58) Field of Classification Search ..... 135/131, 135/144, 145, 146, 157, 120.3; 52/646; 5/15, 182

See application file for complete search history.

(56) References Cited

U.S. PATENT DOCUMENTS

| | | | |
|---|---|---|---|
| 143,119 | A | 9/1873 | Bourgnignon |
| 1,089,103 | A | 3/1914 | Barnard |
| 1,846,011 | A | 2/1932 | Adams |
| 1,958,296 | A | 5/1934 | Crow |
| 2,265,479 | A | 12/1941 | Goodman |
| 4,607,656 | A | 8/1986 | Carter |
| 4,779,635 | A | 10/1988 | Lynch |
| 5,115,828 | A | 5/1992 | Spaulding |
| 5,274,980 | A | 1/1994 | Zeigler |
| 5,421,356 | A | 6/1995 | Lynch |
| 5,490,533 | A | 2/1996 | Carter |
| 5,634,483 | A | 6/1997 | Gwin |
| 5,794,640 | A | 8/1998 | Jang |
| 6,148,835 | A | 11/2000 | Rhee |
| 6,152,157 | A | 11/2000 | Jang |
| 6,230,727 | B1 | 5/2001 | Chen |
| 6,575,656 | B2 | 6/2003 | Suh |
| 6,598,614 | B2 | 7/2003 | Liu |
| 6,601,599 | B2 | 8/2003 | Carter |
| 6,929,017 | B2 * | 8/2005 | Byun ..... 135/131 |
| 2002/0074032 | A1 | 6/2002 | Park et al. |

(Continued)

OTHER PUBLICATIONS

Search Report Dated Dec. 10, 2004 for GB Application No. 0416145.1, 1 page.

*Primary Examiner*—David Dunn
*Assistant Examiner*—Danielle Jackson
(74) *Attorney, Agent, or Firm*—Christie, Parker & Hale, LLP

(57) ABSTRACT

A collapsible canopy frame is provided that includes a plurality of side poles arranged in a configuration and a center pole disposed generally at a center of the configuration of the side poles. The collapsible canopy frame also includes a plurality of edge scissor assemblies each having a length and a midpoint along the length. Each edge scissor assembly is coupled between adjacent ones of the plurality of side poles. The collapsible canopy frame also includes at least one inner scissor assembly including a first end and a second end, wherein the first end is coupled to a corresponding one of the edge scissor assemblies at a position offset from the midpoint along the length of the corresponding one of the edge scissor assemblies, and wherein the second end is coupled to the center pole.

23 Claims, 8 Drawing Sheets

U.S. PATENT DOCUMENTS

2002/0092555 A1 7/2002 Chen et al.
2003/0024563 A1 2/2003 Liu
2003/0172966 A1 9/2003 Dotterweich et al.

* cited by examiner

COLLAPSIBLE CANOPY FRAME HAVING REDUCED TRUSS BAR LENGTH

CROSS-REFERENCE TO RELATED APPLICATION(S)

This application claims priority to and the benefit of Korean Utility Model Application No. 20-2003-0025309 filed on Aug. 6, 2003 in the Korean Intellectual Property Office, now registered as Utility Model Registration No. 2003-31661-0000 on Oct. 20, 2003, the entire content of which is incorporated herein by reference.

FIELD OF THE INVENTION

The present invention relates to a collapsible canopy frame, and more particularly to a collapsible canopy frame having a reduced truss bar length.

BACKGROUND

Conventional collapsible canopy frames typically include four side poles disposed in a square configuration. Typically each pair of adjacent side poles is connected and supported by an edge scissor assembly. Conventional collapsible canopy frames also typically include inner scissor assemblies that are coupled between a corresponding one of the edge scissor assemblies and a center pole.

Each edge scissor assembly and each inner scissor assembly includes a number of hingedly connected scissor units. Each scissor unit includes two hingedly connected truss bars that move in a scissor-like manner. As such, the edge scissor assemblies and inner scissor assemblies are movable between an expanded position, forming a stable portable structure, and a retracted position, forming a compacted structure for ease of transport.

However, in order to allow the edge scissor assemblies and the inner scissor assemblies to each move between the expanded and retracted positions, one end of each inner scissor assembly is typically connected to an end of one of the scissor units of the edge scissor assembly. In order to allow for such a connection, each edge scissor assembly typically includes two scissor units connected to each other at one of their ends and further connected at these same ends to an end of a corresponding one of the inner scissor assemblies.

However, with only two scissor units in each edge scissor assembly, the length of the truss bars in each edge scissor assembly is typically relatively long, preventing the retracted collapsible canopy frame from fitting within some convenient transportation devices, such as a trunk of a typical automobile.

Accordingly, a need exists for a collapsible canopy frame having edge scissor assemblies with reduced truss bar lengths. In an exemplary embodiment according to the present invention, each edge scissor assembly includes more than two scissor units, thereby allowing the truss bar length of each edge scissor assembly to be reduced.

SUMMARY

In an exemplary embodiment, the present invention is a collapsible canopy frame that includes a plurality of side poles arranged in a configuration and a center pole disposed generally at a center of the configuration of the side poles. The collapsible canopy frame also includes a plurality of edge scissor assemblies each having a length and a midpoint along the length, wherein each edge scissor assembly is coupled between adjacent ones of the plurality of side poles. The collapsible canopy frame also includes at least one inner scissor assembly including a first end and a second end, wherein the first end is coupled to a corresponding one of the edge scissor assemblies at a position offset from the midpoint along the length of the corresponding one of the edge scissor assemblies, and wherein the second end is coupled to the center pole.

In another exemplary embodiment, the present invention is a collapsible canopy frame that includes a plurality of side poles and a center pole disposed generally at a center of the collapsible canopy frame. The collapsible canopy frame also includes a plurality of edge scissor assemblies each having a length and a midpoint along the length, wherein each edge scissor assembly is coupled between adjacent ones of the plurality of side poles, and wherein each of the plurality of edge scissor assemblies includes three scissor units pivotally coupled to each other in series. The collapsible canopy frame also includes at least one inner scissor assembly having a first end and a second end, wherein the first end is coupled to a corresponding one of the edge scissor assemblies at a position offset from the midpoint along the length of the corresponding one of the edge scissor assemblies, and wherein the second end is coupled to the center pole.

In yet another exemplary embodiment, the present invention is a collapsible canopy frame that includes a plurality of side poles arranged in a configuration and a center pole disposed generally at a center of the configuration of the side poles. The collapsible canopy frame also includes a plurality of edge scissor assemblies, wherein each edge scissor assembly is coupled between adjacent ones of the plurality of side poles, and wherein each of the plurality of edge scissor assemblies includes at least three scissor units pivotally coupled to each other in series. The collapsible canopy frame also includes at least one inner scissor assembly including at least an inner scissor unit and an outer scissor unit pivotally connected to each other, wherein an end of the outer scissor unit is coupled to a corresponding one of the edge scissor assemblies at a position offset from a midpoint between corresponding adjacent side poles, and wherein the inner scissor unit is coupled to the center pole.

In still another exemplary embodiment, the present invention is a collapsible canopy frame including a plurality of side poles arranged in a configuration with a center pole disposed generally at a center of the configuration of the side poles. The collapsible canopy frame also includes a plurality of edge scissor assemblies, wherein each edge scissor assembly is coupled between adjacent ones of the plurality of side poles; and at least one inner scissor assembly including at least one scissor unit, wherein each scissor unit in the at least one inner scissor assembly includes two truss bars pivotally connected to each other at a position offset from a midpoint along a length of the truss bars.

BRIEF DESCRIPTION OF THE DRAWINGS

Novel features in exemplary embodiments of the present invention will be better understood by reference to the following detailed description when considered in conjunction with the accompanying drawings wherein.

DETAILED DESCRIPTION

As shown in FIGS. 1-8, the present invention is directed to a collapsible canopy frame having edge scissor assemblies with reduced truss bar lengths. In an exemplary embodiment according to the present invention, each edge scissor assembly includes more than two scissor units, thereby allowing the truss bar length of each edge scissor assembly to be reduced.

Figure 1:
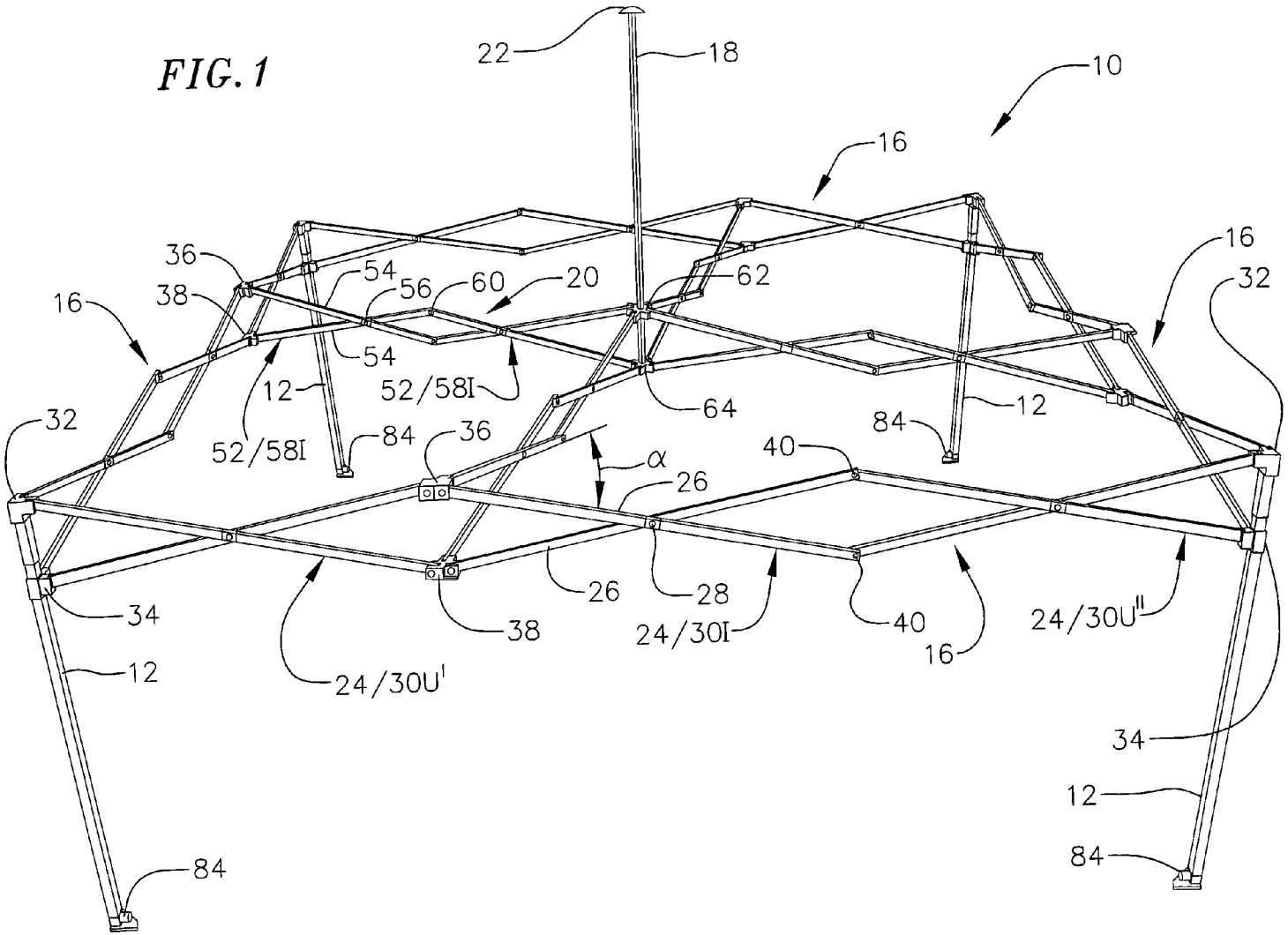
FIG. 1 is a perspective view of a collapsible canopy frame according to an exemplary embodiment of the present invention, shown in an expanded position.

FIG. 1 shows a collapsible canopy frame 10 according to an exemplary embodiment of the present invention. As shown, the collapsible canopy frame 10 includes four side poles 12 arranged in a generally rectangular or square configuration. In other embodiments, however, the collapsible canopy frame 10 may include any appropriate number of side poles 12 arranged in any appropriate configuration, such as pentagonal, hexagonal or octagonal, among other appropriate configurations.

Each pair of adjacent side poles 12 is connected to and supported by an edge scissor assembly 16. Each edge scissor assembly 16 is coupled to and supports a center pole 18 through an inner scissor assembly 20. The center pole 18 is disposed generally at the center of the collapsible canopy frame 10 and has a head member 22, such as a convex shaped head member, which supports a canopy cover (not shown).

Figure 2:
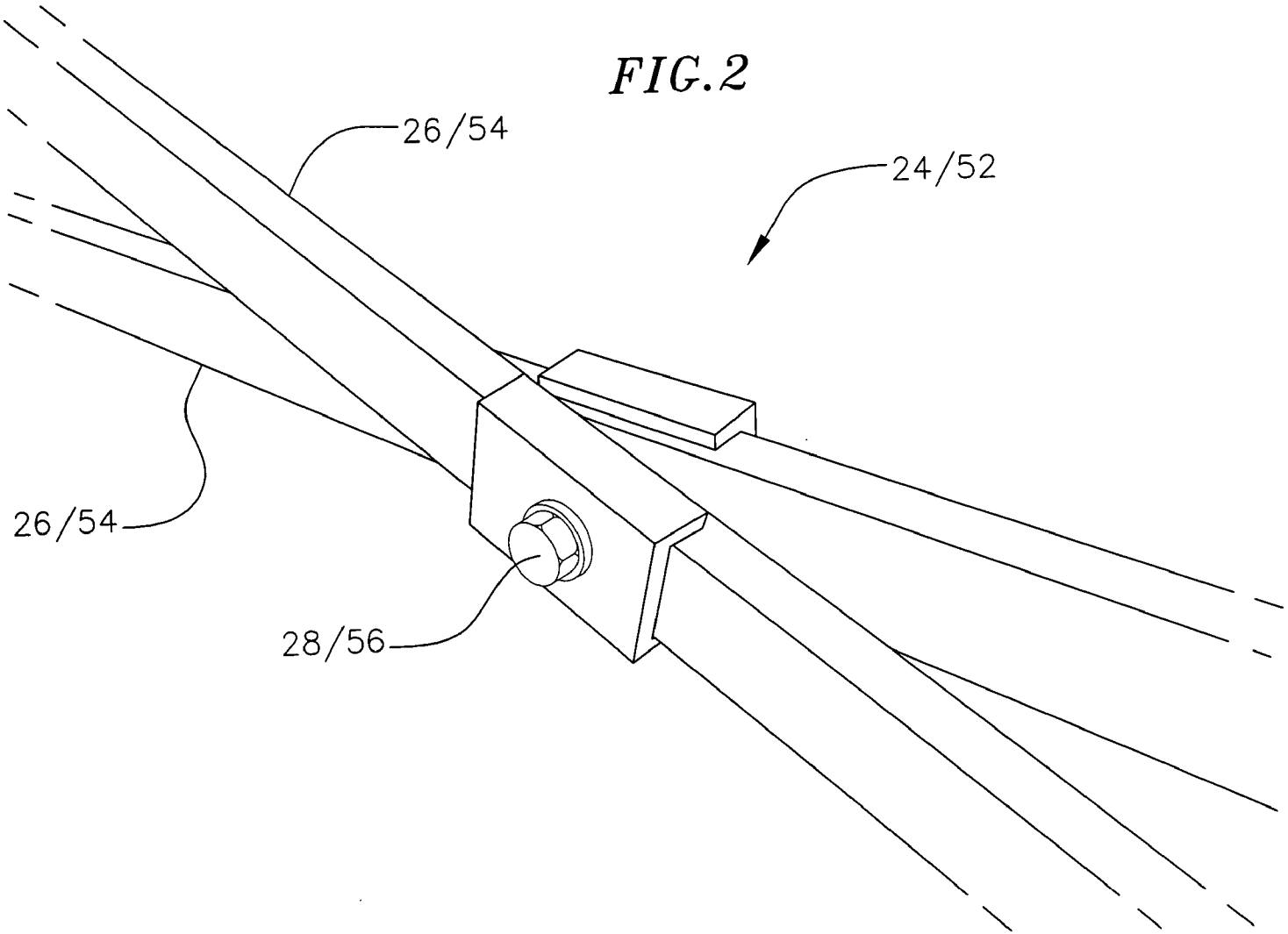
FIG. 2 is an enlarged perspective view of a scissor unit of the collapsible canopy frame of FIG. 1.

In the depicted embodiment, each edge scissor assembly 16 includes three scissor units 24. Each scissor unit 24 includes two hingedly connected truss bars 26 that move about a pivot 28 in a scissor-like manner between an expanded position and a retracted position. As shown in FIG. 2, in one embodiment, the pivot 28 includes a mechanical fastener such as a threaded bolt and nut combination, although other mechanical fasteners are equally appropriate.

Figure 7:
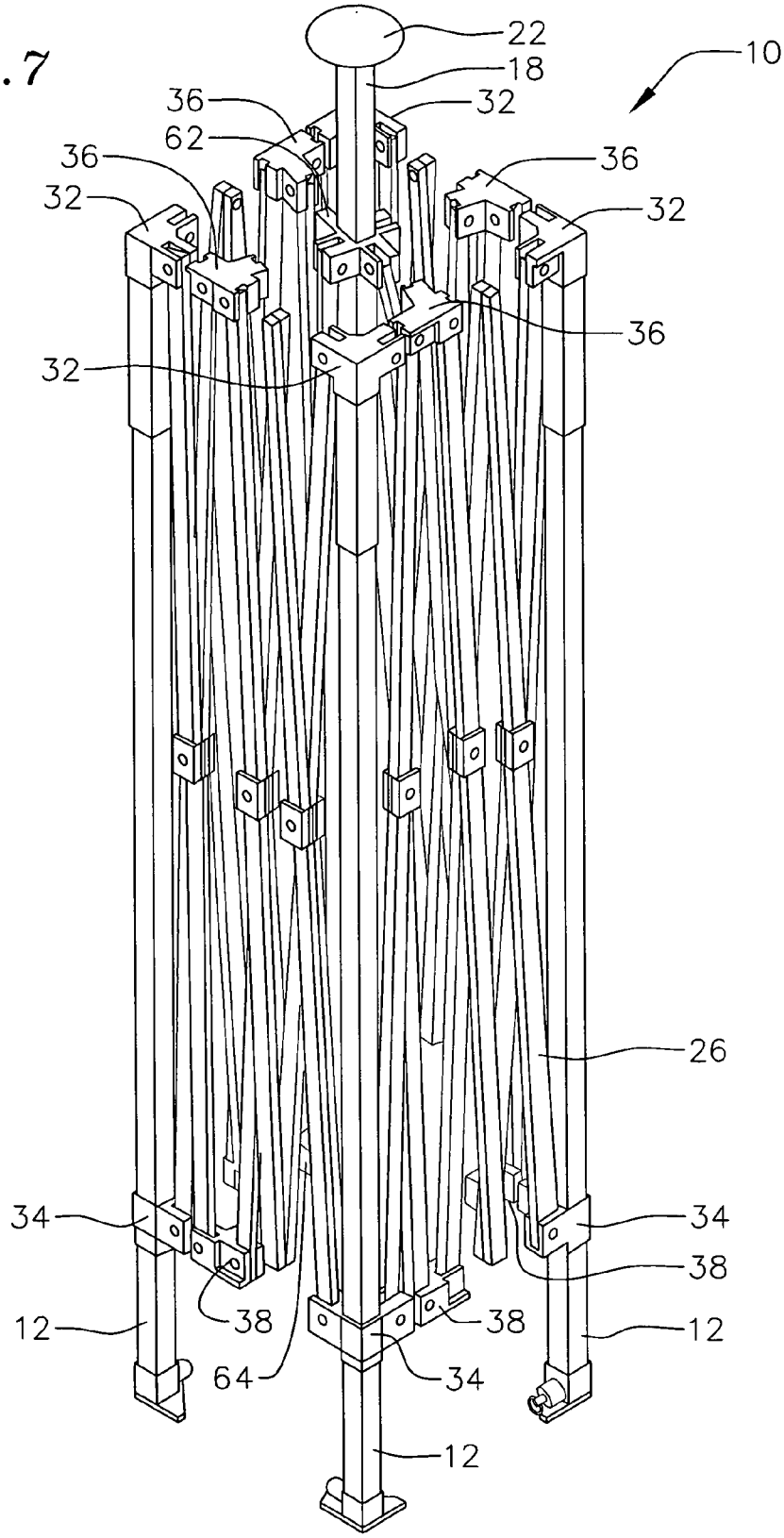
FIG. 7 is a perspective view of the collapsible canopy frame of FIG. 1, shown in a retracted position.

In one embodiment, the truss bars 26 in each scissor unit 24 of each edge scissor assembly 16 have approximately the same length so that the retracted height of each scissor unit 24 in each edge scissor assembly 16 is approximately the same, as shown for example in FIG. 7. In one exemplary embodiment, each truss bar 26 has a length of approximately 1.25 meters or less, for example approximately 1.00 meters.

As shown in FIG. 1, the scissor units 24 within each edge scissor assembly 16 are pivotally connected to each other in series. For example, in the depicted embodiment showing three scissor units 24 per edge scissor assembly 16, each edge scissor assembly 16 includes: a first outer scissor unit 30U' pivotally connected at one end to upper and lower side pole connectors 32 and 34 of a corresponding one of the side poles 12, and pivotally connected at an opposite end to upper and lower scissor unit connectors 36 and 38; an inner scissor unit 30I pivotally connected at one end to the upper and lower scissor unit connectors 36 and 38 and pivotally connected at an opposite end through pins 40 to a second outer scissor unit 30U"; and the second outer scissor unit 30U" pivotally connected at one end to the upper and lower side pole connectors 32 and 34 of a corresponding one of the side poles 12, and pivotally connected at an opposite end to the inner scissor unit 30I through the pins 40.

Figure 3:
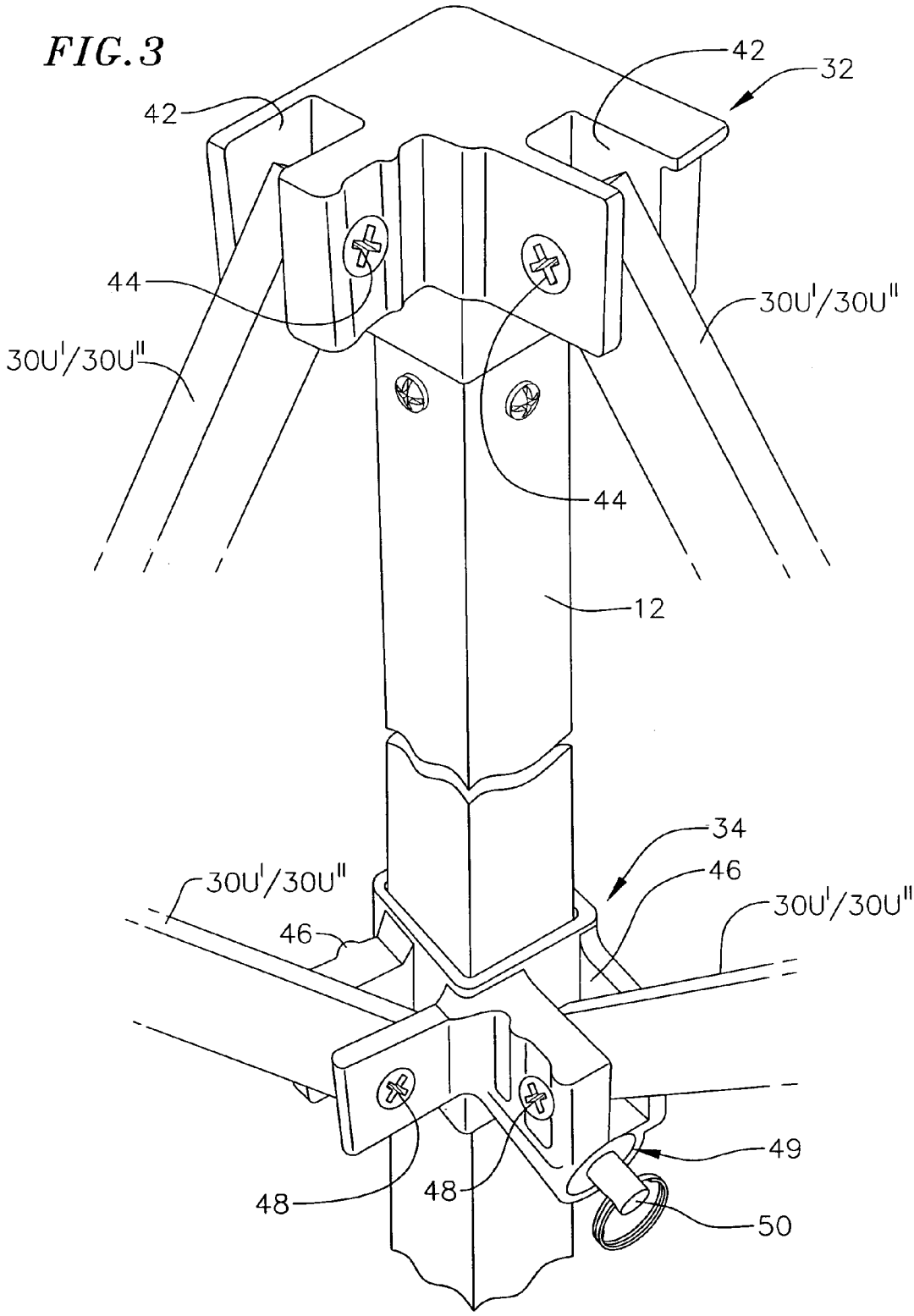
FIG. 3 is an enlarged perspective view of an upper and a lower side pole connecter of the collapsible canopy frame of FIG. 1.

As shown in FIG. 3, each upper side pole connector 32 is fixedly mounted at a top end of a corresponding one of the side poles 12 and includes slots 42 for receiving ends of corresponding outer scissor units 30U' or 30U", and pins 44 that pivotally mount the ends of the scissor units 30U' or 30U" within the slots 42. Each lower side pole connector 34 is disposed in surrounding relation to a corresponding one of the side poles 12 and is slidably mounted thereon. Similar to the upper side pole connectors 32, each lower side pole connector 34 includes slots 46 for receiving ends of corresponding outer scissor units 30U' or 30U", and pins 48 that pivotally mount the ends of the scissor units 30U' or 30U" within the slots 46.

Each lower side pole connector 34 also includes a push/pull pin assembly 49, having a push/pull pin 50 that is spring biased towards the side pole 12. The push/pull pin 50 releasably engages the side pole 12, thereby allowing the height of the lower side pole connector 34 to be adjusted relative to the side pole 12. An exemplary push/pull pin assembly 49 is described in U.S. Pat. No. 6,575,656, which is herein incorporated by reference.

Figure 4:
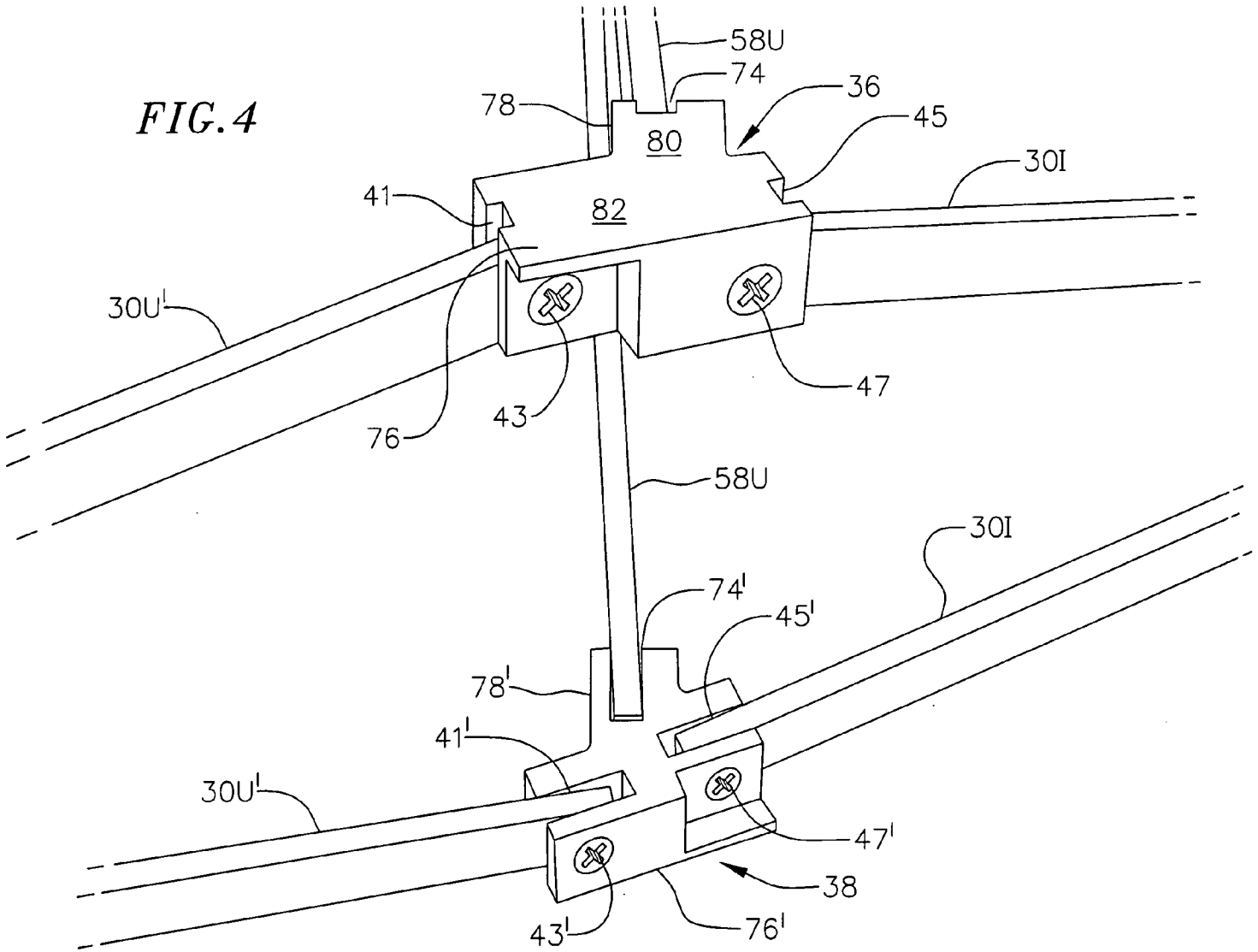
FIG. 4 is an enlarged perspective view of an upper scissor unit connector and a lower scissor unit connecter of the collapsible canopy frame of FIG. 1.

As shown in FIG. 4, the upper scissor unit connector 36 includes a slot 41 for receiving an upper end of the first scissor unit 30U' of a corresponding one of the edge scissor assemblies 16 and a pin 43 for pivotally mounting the upper end of the first scissor unit 30U' within the slot 41; and a slot 45 for receiving an upper end of the inner scissor unit 30I of a corresponding one of the edge scissor assemblies 16 and a pin 47 for pivotally mounting the upper end of the inner scissor unit 30I within the slot 47.

Also shown in FIG. 4 is the lower scissor unit connector 38, which is generally a mirror image of the upper scissor unit connector 36. As such, the lower scissor unit connector 38 includes a slot 41' for receiving a lower end of the first scissor unit 30U' of a corresponding one of the edge scissor assemblies 16 and a pin 43' for pivotally mounting the lower end of the first scissor unit 30U' within the slot 41'; and a slot 45' for receiving a lower end of the inner scissor unit 30I of a corresponding one of the edge scissor assemblies 16 and a pin 47' for pivotally mounting the lower end of the inner scissor unit 30I within the slot 47'.

In the exemplary embodiment of FIG. 1, each inner scissor assembly 20 includes two scissor units 52. Each scissor unit 52 includes two hingedly connected truss bars 54 that move about a pivot 56 in a scissor-like manner between an expanded position and a retracted position. As shown in FIG. 2, in one embodiment, the pivot 56 includes a mechanical fastener such as a threaded bolt and nut combination, although other mechanical fasteners are equally appropriate.

In one embodiment, the truss bars 54 in each scissor unit 52 of each inner scissor assembly 20 have approximately the same length so that the retracted height of each scissor unit 52 in each inner scissor assembly 20 is approximately the same, as shown for example in FIG. 7. In one exemplary embodiment, each truss bar 54 has a length of approximately 1.25 meters or less, for example approximately 0.78 meters or 78 centimeters.

As shown in FIG. 1, the scissor units 52 within each inner scissor assembly 20 are pivotally connected to each other in series. For example, in the depicted embodiment showing two scissor units 52 per inner scissor assembly 20, each inner scissor assembly 20 includes: an outer scissor unit 58U pivotally connected at one end to upper and lower scissor unit connectors 36 and 38, and pivotally connected at an opposite end through pins 60 to an inner scissor unit 58I; and the inner scissor unit 58I pivotally connected at one end through the pins 60 to the outer scissor unit 58U and pivotally connected at an opposite end to upper and lower center pole connectors 62 and 64.

Figure 5:
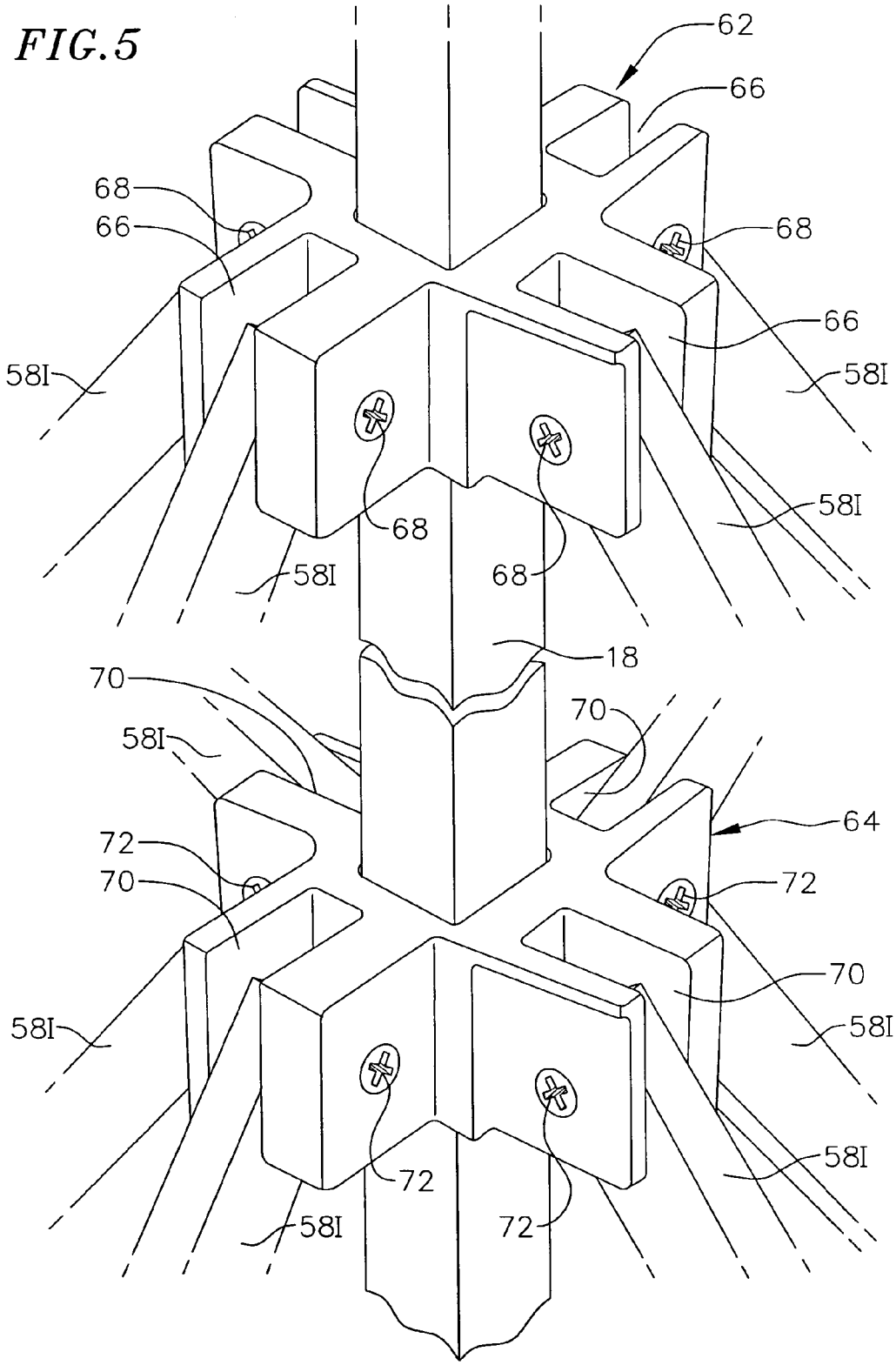
FIG. 5 is an enlarged perspective view of an upper and a lower center pole connecter of the collapsible canopy frame of FIG. 1.

As shown in FIG. 5, the lower center pole connector 64 is fixedly mounted at a bottom end of the center pole 18 and includes slots 70 for receiving an end of the inner scissor unit 58I of each inner scissor assembly 20 and pins 72 that pivotally mount the corresponding ends of the inner scissor units 58I within the slots 70. The upper center pole connector 62 is disposed in surrounding relation to the center pole 18 and is slidably mounted thereon. Similar to the lower center pole connector 64, the upper center pole connector 62 includes slots 66 for receiving an end of the inner scissor unit 58I of each inner scissor assembly 20 and pins 68 that pivotally mount the corresponding ends of the inner scissor units 58I within the slots 70.

As shown in FIG. 4, the upper scissor unit connector 36 includes a slot 74 for receiving an end of the outer scissor unit 58U of a corresponding inner scissor assembly 20 and a pin (not shown) for pivotally mounting the corresponding end of the outer scissor unit 58U within the slot 74. Similarly, the lower scissor unit connector 38 (which is generally a mirror image of the upper scissor unit connector 36) includes a slot 74' for receiving an end of the outer scissor unit 58U of the corresponding inner scissor assembly 20 and a pin (not shown) for pivotally mounting the corresponding end of the outer scissor unit 58U within the slot 74'.

When the collapsible canopy frame 10 according to the present invention is constructed as described above, the collapsible canopy frame 10 is moveable between an expanded position (forming a stable portable structure as shown in FIG. 1), and a retracted position (forming a compacted structure for ease of transport as shown in FIG. 7.)

As the collapsible canopy frame 10 is moved from the expanded position of FIG. 1 to the retracted position of FIG. 7, each lower side pole connector 34 slides downwardly with respect to its corresponding side pole 12. This in turn causes the truss bars 26 of the scissor units 24 of each edge scissor assembly 16 to pivot from their expanded position (i.e., the generally horizontal position of the truss bars 26 as shown in FIG. 1) to their retracted position (i.e., the generally vertical position of the truss bars 26 as shown in FIG. 7.) This movement causes each lower scissor unit connector 38 to move downwardly, which in turn causes the truss bars 54 of the scissor units 52 of each inner scissor assembly 20 to pivot from their expanded position (i.e., the generally horizontal position of the truss bars 54 as shown in FIG. 1) to their retracted positions (i.e., the generally vertical position of the truss bars 54 as shown in FIG. 7.) The retracting of the scissor units 52 of the inner scissor assemblies 20, in turn causes the lower center pole connector 64 to be pulled downwardly and the upper center pole 62 to slide upwardly on the center pole 18. Since the center pole 18 is fixedly connected to the lower center pole connector 64, the center pole 18 also moves downward. This downward movement of the center pole 18 causes the retracted height measured from ground of the center pole 18 to be closer (than in the expanded position of FIG. 1) to the retracted height measured from ground of the side poles 12 as shown in FIG. 7.

In one embodiment, the truss bars 26 of each scissor unit 24 in each edge scissor assembly 16 are longer than the truss bars 54 of each scissor unit 52 in each inner scissor assembly 20. For example, in one embodiment, the truss bars 26 of each scissor unit 24 in each edge scissor assembly 16 are each approximately 1.00 meters in length, and the truss bars 54 of each scissor unit 52 in each inner scissor assembly 20 are each approximately 0.78 meters in length. As such, in order for the retracted height of the scissor units 52 of the inner scissor assemblies 20 to be approximately equal to the retracted height of the scissor units 24 of the edge scissor assemblies 16, the pivot 28 of the scissor units 24 in each edge scissor assembly 16 is positioned approximately at the midpoint of the corresponding truss bars 26 of the scissor units 24 of the inner scissor assemblies 20, while the pivot 56 of the scissor units 52 in each inner scissor assembly 20 is positioned offset from a midpoint of the corresponding truss bars 54 in the scissor units 52 of the inner scissor assemblies 20. For example, in one embodiment, the pivot 56 of each scissor unit 52 in each inner scissor assembly 20 is positioned at a position about two-thirds (e.g., approximately 63%) along the length of the corresponding truss bars 54.

As described above conventional collapsible canopy frames typically include edge scissor assemblies having two scissor units connected to each other at one of their ends and further connected at these same ends to the ends of a corresponding one of the inner scissor assemblies. In such an arrangement, each inner scissor assembly is connected to its corresponding edge scissor assembly at a position disposed at the midpoint of the edge scissor assembly, or stated another way, each inner scissor assembly is connected to its corresponding edge scissor assembly at a position at a midpoint between its corresponding adjacent side poles.

As such, each inner scissor assembly extends perpendicularly from its corresponding edge scissor assembly to connect to its center pole. As such upper and lower scissor unit connectors for such frames are typically T-shaped, with the ends of one of the arms of the T receiving scissor units from the edge scissor assembly and the perpendicular arm of the T receiving a scissor unit from the inner scissor assembly.

By contrast, since each edge scissor assembly 16 of FIG. 1 has three scissor units 24, and the inner scissor assembly 20 is connected to the ends of the first outer scissor unit 30U' and the inner scissor unit 30I (i.e. at the ends of the first and second scissor units 24 in a series of three scissor units 24), the inner scissor assembly 20 forms an acute angle $\alpha$ (as shown in FIG. 1) when connected between its corresponding edge scissor assembly 16 and the center pole 18.

Figure 6:
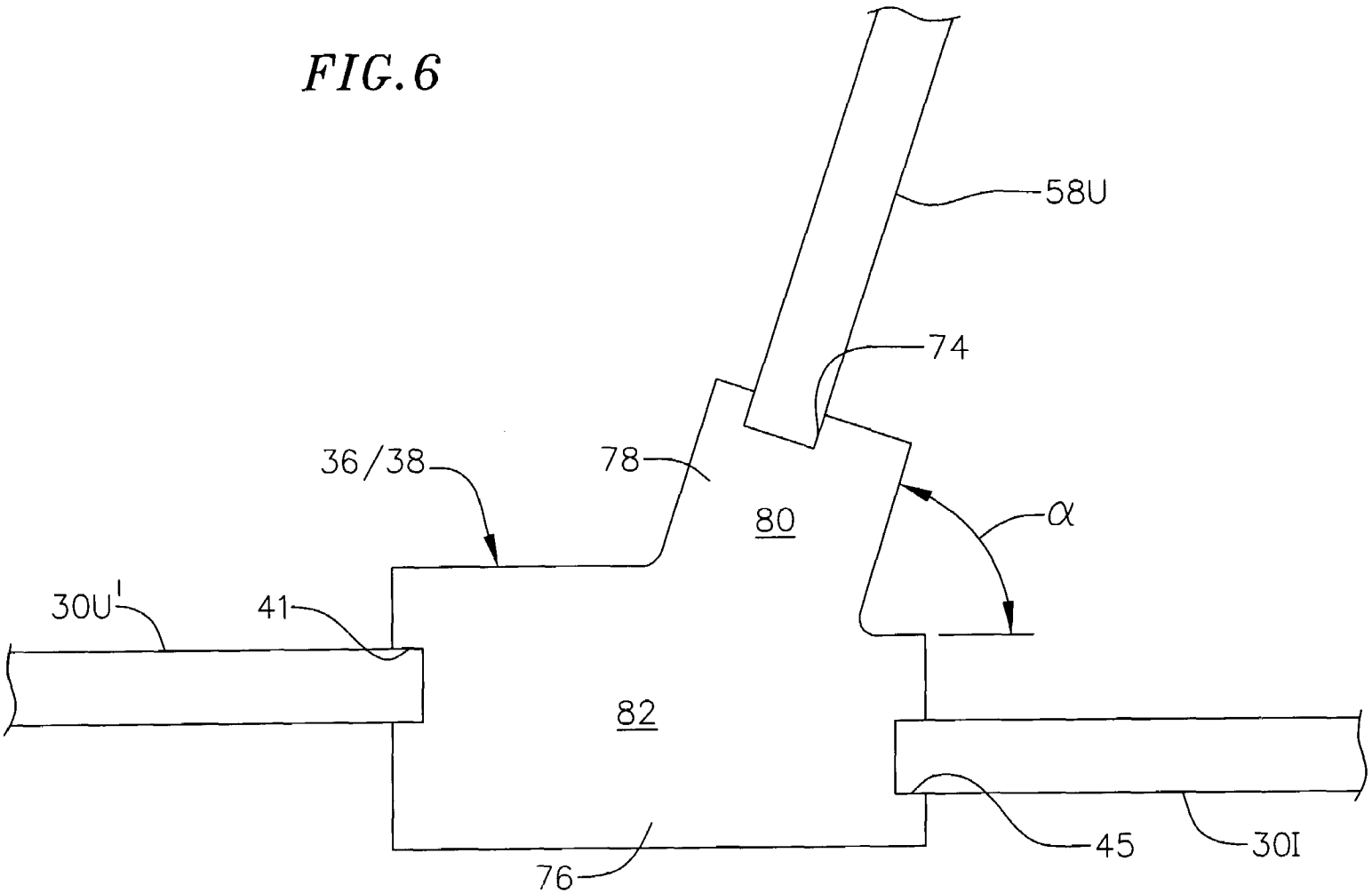
FIG. 6 is a top view of the upper scissor unit connecter of FIG. 4.

The upper scissor unit connector 36 has a base 76 (as shown in FIG. 6) having at one end the slot 41 for receiving an end of the first outer scissor unit 30U', and having at an opposite end the slot 45 for receiving an end of the inner scissor unit 30I. Connected to the base 76 of the upper scissor unit connector 36 is an arm 78 that extends therefrom at approximately the same acute angle $\alpha$ at which the inner scissor assembly 20 is connected between the edge scissor assembly 16 and the center pole 18. It should be noted that the upper surface 80 of the extending arm 78 is co-planer with the upper surface 82 of its corresponding base 76 (as shown in FIGS. 4 and 6.)

As such the angled arm 78 of the upper scissor unit connector 36 allows each inner scissor assembly 20 to be connected to its corresponding edge scissor assembly 16 at a position offset from a midpoint of the edge scissor assembly 16. Stated another way, the angled arm 78 of the upper scissor unit connector 36 allows each inner scissor assembly 20 to be connected to its corresponding edge scissor assembly 16 at a position offset from a midpoint between its corresponding adjacent side poles 12. Thus, each edge scissor assembly 16 can include more than two scissor units 24, such as the three scissor units 24 as shown in FIG. 1.

Since the lower scissor unit connector 38 is generally a mirror image of the upper scissor unit connector 36, the lower scissor unit connector has a base 76', which is generally parallel to the base 76 of the upper scissor unit connector 36. The lower scissor unit connector 36 has an arm 78' that forms approximately the same acute angle $\alpha$ with the base 76', as the angle $\alpha$ between the base 76 and the arm 78. Hence the lower scissor unit connector 38, working in conjunction with the upper scissor unit connector 36, allows each inner scissor assembly 20 to be connected to its corresponding edge scissor assembly 16 at a position offset from a midpoint of the edge scissor assembly 16.

In the depicted embodiment, each inner scissor assembly 20 is connected to its corresponding edge scissor assembly 16 at a position of approximately one third of the total length of the edge scissor assembly 16, or approximately at a position of approximately one third of the total distance between the corresponding adjacent side poles 12.

Although the above described exemplary embodiments discuss each inner scissor assembly 20 as being connected at the ends of the first outer scissor unit 30U' and the inner scissor unit 30I of each edge scissor assembly 16, in an alternative embodiment each inner scissor assembly 20 is connected at the ends of the second outer scissor unit 30U" and the inner scissor unit 30I of each edge scissor assembly 16.

Also, although the above described exemplary embodiments discuss each edge scissor assembly 16 as including three scissor units 24, each edge scissor assembly 16 may include any suitable number of scissor units 24 and each inner scissor assembly 20 may be attached to the series of scissor units 24 within a corresponding edge scissor assembly 16 at the ends of any two adjacent scissor units 24. However, it should be noted that the acute angle $\alpha$ that the extending arm 78 makes with the base 76 of the upper scissor unit connector 36 is dependent on which scissor units 24 that the inner scissor assembly 20 is attached to in the series of scissor units 24 within each edge scissor assembly 16. For example, the angle $\alpha$ of the angled arm 78 of the upper scissor unit connector 36 is smaller when the inner scissor assembly 20 is connected at the ends of the first and second scissor units 24 in a series of five scissor units 24 than when the inner scissor assembly 20 is connected at the ends of the second and third scissor units 24 in a series of five scissor units 24.

Figure 8:
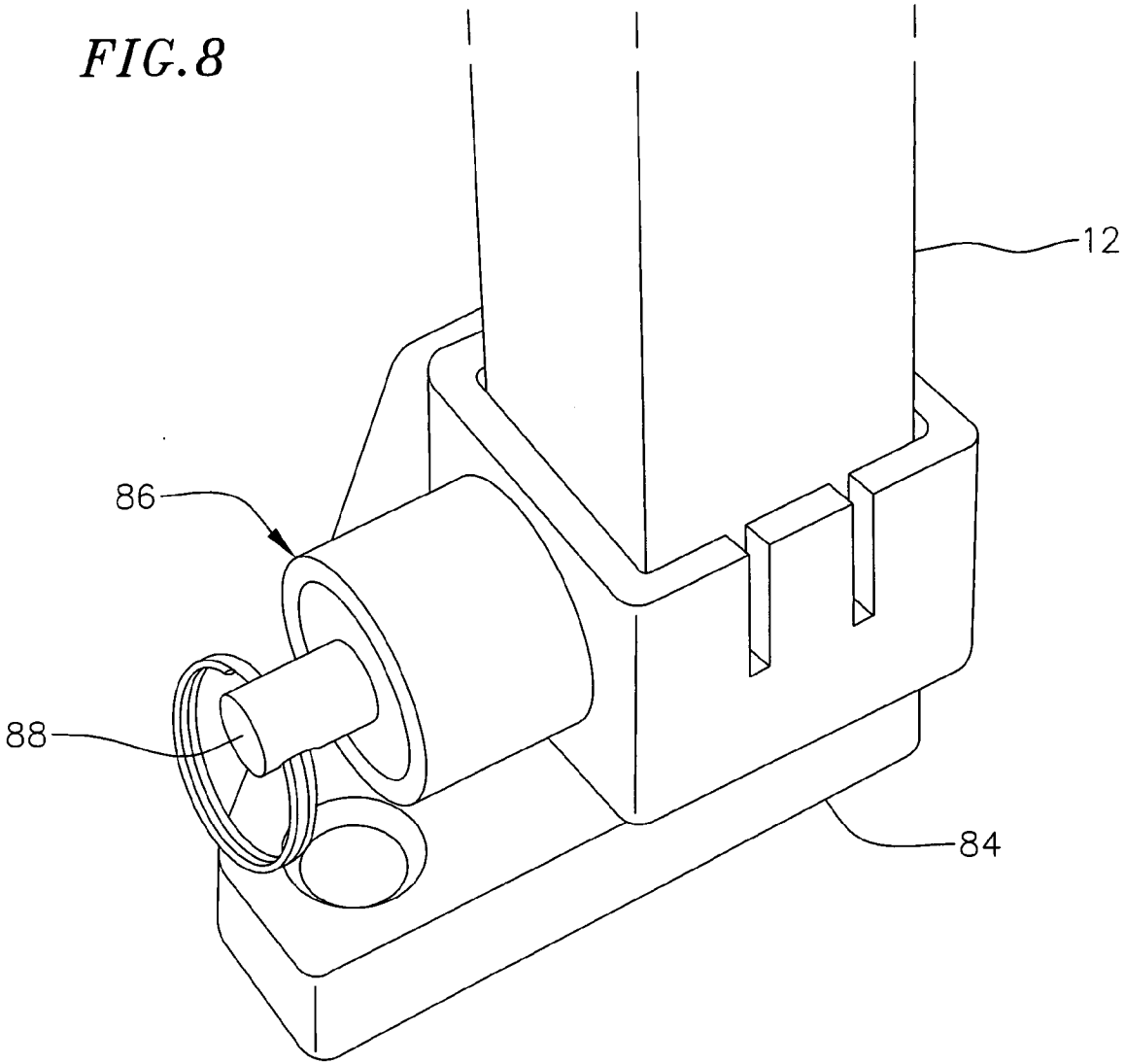
FIG. 8 is an enlarged perspective view of a lower end of a side pole 12 of the collapsible canopy frame of FIG. 1.

As shown in FIGS. 1 and 8, each side pole 12 includes a support plate or foot 84 attached at a bottom end thereof for supporting the weight of the collapsible canopy frame 10. In one embodiment, each side pole 12 is telescoping, thereby allowing the height of each side pole 12 to be independently adjusted. The telescoping side pole includes an upper pole section and a lower pole section that are slidable with respect to one another. The telescoping side pole in other embodiments may have three or more pole sections.

To fix the side pole 12 in an elongated position, a push/pull pin assembly 86 is mounted near a lower end of the upper pole section. The push/pull pin assembly 86 has a push/pull pin 88 that is spring biased towards the side pole 12. The push/pull pin 88 releasable engages the upper and lower sections of the side pole 12, thereby allowing the height of the side pole 12 to be adjusted. An exemplary push/pull pin assembly 86 and an exemplary method for adjusting the height of a telescoping side pole is described in U.S. Pat. No. 6,575,656, which is herein incorporated by reference.

It should be noted that the reduced truss bar length of the collapsible canopy frame of the current invention allows more scissor assemblies to be used in each side of the frame than is possible with larger truss bars, since larger truss bars can create frames that are undesirable long. The increased number of scissor assemblies for each side of the frame increases the structural stability of the frame.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

I claim:

1. A collapsible canopy frame comprising:

a plurality of side poles arranged in a configuration;

a center pole disposed generally at a center of the configuration of the side poles;

a plurality of edge scissor assemblies each having a length and a midpoint along the length, wherein each edge scissor assembly is coupled between adjacent ones of the plurality of side poles; and at least one inner scissor assembly comprising a first end and a second end, wherein the first end is coupled to a corresponding one of the edge scissor assemblies at a position between one end and the midpoint along the length of said corresponding one of the edge scissor assemblies, and wherein the second end is coupled to the center pole.

2. The collapsible canopy frame of claim 1, wherein each of the plurality of edge scissor assemblies comprises an odd number of scissor units.

3. The collapsible canopy frame of claim 1, wherein each of the plurality of edge scissor assemblies comprises three scissor units pivotally coupled to each other in series.

4. The collapsible canopy frame of claim 3, wherein each scissor unit in each of the plurality of edge scissor assemblies comprises two truss bars pivotally connected to each other with each truss bar having a length of approximately 1.25 meters or less.

5. The collapsible canopy frame of claim 1, further comprising a scissor unit connector having a base and an angled arm extending from the base at an acute angle, wherein the first end of the at least one inner scissor assembly is pivotally connected to the angled arm, and the corresponding one of the edge scissor assemblies is pivotally connected to the base.

6. The collapsible canopy frame of claim 1, wherein the at least one inner scissor assembly comprises at least two inner scissor assemblies offset from each other by approximately 180 degrees.

7. The collapsible canopy frame of claim 1, wherein the at least one inner scissor assembly comprises at least four inner scissor assemblies symmetrically disposed about the center pole.

8. A collapsible canopy frame comprising:

a plurality of side poles arranged in a configuration;

a center pole disposed generally at a center of the configuration of the side poles;

a plurality of edge scissor assemblies each having a length and a midpoint along the length, wherein each edge scissor assembly is coupled between adjacent ones of the plurality of side poles;

at least one inner scissor assembly comprising a first end and a second end, wherein the first end is coupled to a corresponding one of the edge scissor assemblies at a position offset from the midpoint along the length of said corresponding one of the edge scissor assemblies, and wherein the second end is coupled to the center pole;

wherein each of the plurality of edge scissor assemblies comprises three scissor units pivotally coupled to each other in series;

wherein the three scissor units in each of the plurality of edge scissor assemblies comprises a first outer scissor unit, an intermediate scissor unit, and a second outer scissor unit, such that the first end of the at least one inner scissor assembly is coupled to ends of both the first outer scissor unit and the intermediate scissor unit of a corresponding one of the edge scissor assemblies.

9. A collapsible canopy frame comprising:

a plurality of side poles arranged in a configuration;

a center pole disposed generally at a center of the configuration of the side poles;

a plurality of edge scissor assemblies each having a length and a midpoint along the length, wherein each edge scissor assembly is coupled between adjacent ones of the plurality of side poles; and at least one inner scissor assembly comprising a first end and a second end, wherein the first end is coupled to a corresponding one of the edge scissor assemblies at a position offset from the midpoint along the length of said corresponding one of the edge scissor assemblies, and wherein the second end is coupled to the center pole;

further comprising a scissor unit connector having a base and an angled arm extending from the base at an acute angle, wherein the first end of the at least one inner scissor assembly is pivotally connected to the angled arm, and the corresponding one of the edge scissor assemblies is pivotally connected to the base;

wherein each of the plurality of edge scissor assemblies comprises three scissor units pivotally coupled to each other in series and comprising a first outer scissor unit, an intermediate scissor unit, and a second outer scissor unit, such that the first outer scissor unit of the corresponding one of the edge scissor assemblies is pivotally connected to one end of the base of the scissor unit connector; and the intermediate scissor unit of the corresponding one of the edge scissor assemblies is pivotally connected to another end of the base of the scissor unit connector.

10. A collapsible canopy frame comprising:

a plurality of side poles arranged in a configuration;

a center pole disposed generally at a center of the configuration of the side poles;

a plurality of edge scissor assemblies each having a length and a midpoint along the length, wherein each edge scissor assembly is coupled between adjacent ones of the plurality of side poles;

at least one inner scissor assembly comprising a first end and a second end, wherein the first end is coupled to a corresponding one of the edge scissor assemblies at a position offset from the midpoint along the length of said corresponding one of the edge scissor assemblies, and wherein the second end is coupled to the center pole;

wherein the first end of the at least one inner scissor assembly is coupled to said corresponding one of the edge scissor assemblies at a position approximately one third along the length of said corresponding one of the edge scissor assemblies.

11. A collapsible canopy frame comprising:

a plurality of side poles arranged in a configuration;

a center pole disposed generally at a center of the configuration of the side poles;

a plurality of edge scissor assemblies each having a length and a midpoint along the length, wherein each edge scissor assembly is coupled between adjacent ones of the plurality of side poles;

at least one inner scissor assembly comprising a first end and a second end, wherein the first end is coupled to a corresponding one of the edge scissor assemblies at a position offset from the midpoint along the length of said corresponding one of the edge scissor assemblies, and wherein the second end is coupled to the center pole;

wherein the at least one inner scissor assembly comprises a first scissor unit and a second scissor unit pivotally connected to each other, and wherein each scissor unit in the at least one inner scissor assembly comprises two truss bars pivotally connected to each other at a position offset from a midpoint along a length of the truss bars.

12. A collapsible canopy frame comprising:

a plurality of side poles;

a center pole disposed generally at a center of the collapsible canopy frame;

a plurality of edge scissor assemblies each having a length and a midpoint along the length, wherein each edge scissor assembly is coupled between adjacent ones of the plurality of side poles, and wherein each of the plurality of edge scissor assemblies comprises three scissor units pivotally coupled to each other in series; and at least one inner scissor assembly comprising a first end and a second end, wherein the first end is coupled to a corresponding one of the edge scissor assemblies at a position between one end and the midpoint along the length of said corresponding one of the edge scissor assemblies, and wherein the second end is coupled to the center pole.

13. The collapsible canopy frame of claim 12, wherein each scissor unit in each of the plurality of edge scissor assemblies comprises two truss bars pivotally connected to each other with each truss bar having a length of 1.25 meters or less.

14. The collapsible canopy frame of claim 12, wherein each scissor unit in each of the plurality of edge scissor assemblies comprises two truss bars pivotally connected to each other, and wherein the at least one inner scissor assembly comprises a first scissor unit and a second scissor unit pivotally connected to each other, and wherein each scissor unit in the at least one inner scissor assembly comprises two truss bars pivotally connected to each other, such that each truss bar of each scissor unit in each of the plurality of edge scissor assemblies has a length greater than a length of each truss bar of each scissor unit in the at least one inner scissor assembly.

15. The collapsible canopy frame of claim 14, wherein each truss bar of each scissor unit in each of the plurality of edge scissor assemblies has approximately the same length, and wherein each truss bar of each scissor unit in the at least one inner scissor assembly has approximately the same length.

16. The collapsible canopy frame of claim 15, wherein the length of the truss bars of each scissor unit in each of the plurality of edge scissor assemblies is approximately 1.25 meters or less, and wherein the length of the truss bar of each scissor unit in the at least one inner scissor assembly is approximately 1.25 meters or less.

17. A collapsible canopy frame comprising:

a plurality of side poles;

a center pole disposed generally at a center of the collapsible canopy frame;

a plurality of edge scissor assemblies each having a length and a midpoint along the length, wherein each edge scissor assembly is coupled between adjacent ones of the plurality of side poles, and wherein each of the plurality of edge scissor assemblies comprises three scissor units pivotally coupled to each other in series;

at least one inner scissor assembly comprising a first end and a second end, wherein the first end is coupled to a corresponding one of the edge scissor assemblies at a position offset from the midpoint along the length of said corresponding one of the edge scissor assemblies, and wherein the second end is coupled to the center pole;

wherein the three scissor units in each of the plurality of edge scissor assemblies comprise a first outer scissor unit, an intermediate scissor unit, and a second outer scissor unit, such that the first end of the at least one inner scissor assembly is coupled to ends of both the first outer scissor unit and the intermediate scissor unit of the corresponding one of the edge scissor assemblies.

18. The collapsible canopy frame of claim 17, further comprising a scissor unit connector having a base and an angled arm extending from the base at an acute angle, wherein the first end of the at least one inner scissor assembly is pivotally connected to the angled arm, and the base is pivotally connected to the ends of both the first outer scissor unit and the intermediate scissor unit of the corresponding one of the edge scissor assemblies.

19. The collapsible canopy frame of claim 18, wherein the first outer scissor unit of the corresponding one of the edge scissor assemblies is pivotally connected to one end of the base of the scissor unit connector; and the intermediate scissor unit of the corresponding one of the edge scissor assemblies is pivotally connected to another end of the base of the scissor unit connector.

20. A collapsible canopy frame comprising:

a plurality of side poles;

a center pole disposed generally at a center of the collapsible canopy frame;

a plurality of edge scissor assemblies each having a length and a midpoint along the length, wherein each edge scissor assembly is coupled between adjacent ones of the plurality of side poles, and wherein each of the plurality of edge scissor assemblies comprises three scissor units pivotally coupled to each other in series;

at least one inner scissor assembly comprising a first end and a second end, wherein the first end is coupled to a corresponding one of the edge scissor assemblies at a position offset from the midpoint along the length of said corresponding one of the edge scissor assemblies, and wherein the second end is coupled to the center pole;

wherein the first end of the at least one inner scissor assembly is coupled to said corresponding one of the edge scissor assemblies at a position approximately one third along the length of said corresponding one of the edge scissor assemblies.

21. A collapsible canopy frame comprising:

a plurality of side poles;

a center pole disposed generally at a center of the collapsible canopy frame;

a plurality of edge scissor assemblies each having a length and a midpoint along the length, wherein each edge scissor assembly is coupled between adjacent ones of the plurality of side poles, and wherein each of the plurality of edge scissor assemblies comprises three scissor units pivotally coupled to each other in series;

at least one inner scissor assembly comprising a first end and a second end, wherein the first end is coupled to a corresponding one of the edge scissor assemblies at a position offset from the midpoint along the length of said corresponding one of the edge scissor assemblies, and wherein the second end is coupled to the center pole;

wherein the at least one inner scissor assembly comprises a first scissor unit and a second scissor unit pivotally connected to each other, and wherein each scissor unit in the at least one inner scissor assembly comprises two truss bars pivotally connected to each other at a position offset from a midpoint along a length of the truss bars.

22. A collapsible canopy frame comprising:

a plurality of side poles arranged in a configuration;

a center pole disposed generally at a center of the configuration of the side poles;

a plurality of edge scissor assemblies, wherein each edge scissor assembly is coupled between adjacent ones of the plurality of side poles, and wherein each of the plurality of edge scissor assemblies comprises an odd number of scissor units; and at least one inner scissor assembly comprising at least an inner scissor unit and an outer scissor unit pivotally connected to each other, wherein an end of the outer scissor unit is coupled to a corresponding one of the edge scissor assemblies at a position between an end of the one of the edge scissor assemblies and a midpoint between corresponding adjacent side poles, and wherein the inner scissor unit is coupled to the center pole.

23. The collapsible canopy frame of claim 22, wherein each of the plurality of edge scissor assemblies comprises at least three scissor units pivotally coupled to each other in series.

* * * * *